US006242169B1

(12) United States Patent
Hagemann et al.

(10) Patent No.: US 6,242,169 B1
(45) Date of Patent: Jun. 5, 2001

(54) COLOR PHOTOGRAPHIC MATERIAL

(75) Inventors: Jörg Hagemann, Köln; Günter Helling, Odenthal; Heinz Wiesen, Euskirchen, all of (DE)

(73) Assignee: Agfa-Gevaert (BE)

( * ) Notice: Subject to any disclaimer, the term of this patent is extended or adjusted under 35 U.S.C. 154(b) by 0 days.

(21) Appl. No.: 09/393,859

(22) Filed: Sep. 10, 1999

(30) Foreign Application Priority Data

Sep. 19, 1998 (DE) ..... 198 43 057

(51) Int. Cl.[7] ..... G03C 1/08; G03C 7/26; G03C 7/32

(52) U.S. Cl. ..... 430/546; 430/551; 430/558

(58) Field of Search ..... 430/543, 546, 430/558, 551

(56) References Cited

U.S. PATENT DOCUMENTS

| | | | | |
|---|---|---|---|---|
| 5,403,704 | * | 4/1995 | Yoshioka et al. | 430/558 |
| 5,679,506 | * | 10/1997 | Ikesu et al. | 430/558 |
| 5,756,274 | | 5/1998 | Matsuda et al. | 430/558 |

FOREIGN PATENT DOCUMENTS

| | | |
|---|---|---|
| 0 145 342 | 6/1985 | (EP) . |
| 0 545 305 | 6/1993 | (EP) . |
| 0 610 029 | 8/1994 | (EP) . |
| 717 315 | 12/1995 | (EP) . |
| 1-172956 | 7/1989 | (JP) . |

* cited by examiner

*Primary Examiner*—Geraldine Letscher
(74) *Attorney, Agent, or Firm*—Connolly Bove Lodge & Hutz LLP

(57) ABSTRACT

A color photographic material containing at least one silver halide emulsion layer sensitised for the red range of the spectrum, which material contains at least one compound of the formula (I)

(I)

in which $R^{11}$ and $R^{12}$ mutually independently denote an electron-attracting group, $X^{11}$ denotes H or a group seperable on reaction with the developer oxidation product, $Y^{11}$ denotes a group to complete a nitrogenous heterocycle, providing that a group represented by $R^{12}$ is attached to a carbon atom of the heterocycle, n denotes 1 or 2, and at least one compound of the formula (II)

(II)

in which $R^{21}$ denotes alkyl, alkenyl, aryl, alkoxy, aryloxy, alkylamino, arylamino, acyl, acylamino, acyloxy, hetaryl, halogen, nitro or cyano, $R^{22}$ denotes OH or has the same meaning as $R^{21}$, n,m mutually independently denote 0 or 1, o denotes 0, 1, 2, 3, 4 or 5, providing that the compound contains a total of at least 16 C atoms, is distinguished by improved light stability.

13 Claims, No Drawings

COLOR PHOTOGRAPHIC MATERIAL

This invention relates to a colour photographic material containing an emulsified heterocyclic cyan coupler from the group of pyrazoloazoles and certain coupler solvents.

It is known to produce coloured photographic images by chromogenic development, i.e. by developing silver halide emulsion layers exposed with an image by means of suitable chromogenic developer substances, so-called colour developers, in the presence of suitable colour couplers, wherein the oxidation product of the developer substance, which oxidation product is produced congruently with the silver image, reacts with the colour coupler to form a dye image.

Naphtholic or phenolic cyan couplers are conventionally used to produce the cyan component colour image. The latter have hitherto been preferred in colour photographic print materials due to the more favourable absorption (at approx. 660 nm) and greater dark storage stability of the image dyes produced therefrom on chromogenic development.

However, in comparison with the image dyes produced from conventional pivaloylacetanilide yellow couplers and pyrazolotriazole magenta coupler, the dark storage stability is inadequate. Moreover, the phenolic cyan dyes have a relatively large half-width, which gives rise to a distinct, unwanted absorption in the green range of the spectrum.

In order to eliminate these disadvantages it has been proposed, inter alia in EP 717 315, to use specially substituted pyrazoloazoles as cyan couplers. However, in conventional coupler solvents, the dyes produced from these couplers exhibit an unwanted shift of the absorption flank towards shorter wavelengths. Excessively low light stability is another disadvantage.

The object of the present invention was to provide colour photographic materials containing pyrazoloazole cyan couplers which are distinguished by improved light stability and which simultaneously exhibit thermal stability. A further object was to provide cyan couplers having colour reproduction which is distinctly improved in comparison with known prior art materials.

The present invention provides a colour photographic material containing at least one silver halide emulsion layer sensitised for the red range of the spectrum, which layer contains associated therewith at least one compound of the formula (I)

(I)

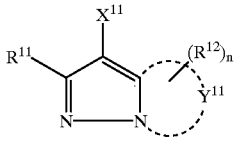

in which $R^{11}$ and $R^{12}$ mutually independently denote an electron-attracting group, $X^{11}$ denotes H or a group seperable on reaction with the developer oxidation product, $Y^{11}$ denotes a group to complete a nitrogenous heterocycle, providing that a group represented by $R^{12}$ is attached to a carbon atom of the heterocycle, n denotes 1 or 2, and at least one compound of the formula (II)

(II)

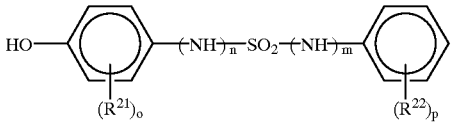

in which $R^{21}$ denotes alkyl, alkenyl, aryl, alkoxy, aryloxy, alkylamino, arylamino, acyl, acylamino, acyloxy, hetaryl, halogen, nitro or cyano, $R^{22}$ denotes OH or has the same meaning as $R^{21}$, n, m mutually independently denote 0 or 1, o denotes 0, 1, 2, 3, 4 or 5, providing that the compound contains a total of at least 16 C atoms.

For the purposes of the present application, alkyl should be taken to mean linear or branched, straight-chain or cyclic, substituted or unsubstituted hydrocarbon groups, preferably alkyl groups having 1 to 32 C atoms. Open-chain alkyl groups which may be considered are in particular methyl, ethyl, n-propyl, n-butyl, n-octyl, n-dodecyl, n-hexadecyl and n-octadecyl, while branched alkyl residues are in particular 2-hexyl-decyl, 2-octyldodecyl and 2-ethylhexyl residues. Preferred cycloalkyl groups are cyclohexyl, in particular 4-t.-butylcyclohexyl, 2,6-di-t.-butyl-4-methylcyclohexyl. For the purposes of the present application, alkenyl should be taken to mean linear or branched cyclic or straight-chain substituted or unsubstituted unsaturated hydrocarbon residues, such as for example ethenyl, 2-propenyl, isopropenyl and oleyl. For the purposes of the present application, aryl should be taken to mean aromatic hydrocarbons, wherein phenyl or naphthyl is preferred. These may be both substituted and unsubstituted. For the purposes of the present application, hetaryl should be taken to mean aromatic systems which contain at least one heteroatom. These also preferably comprise 5- or 6-membered ring systems, which may present not only as monocyclic but also as fused ring systems. The ring systems may in this case be both substituted and unsubstituted ring systems. Heteroatoms which may in particular be considered here are N, S and O. A ring system may preferably have between 1 and 3 heteroatoms, wherein the heteroatoms may be identical or different. In the case of fused ring systems, two or more identical or different heterocyclic systems may be fused, as well as hetaryls with arylene. Typical examples are: pyridine, pyridazine, pyrimidine, pyrazine, oxazole, isoxazole, thiazole, 3,4-oxadiazole, 1,2,4-oxadiazole, imidazole, 1,2,3-triazole, 1,2,4-triazole, in particular furan, pyrrole, thiophene and indole.

For the purposes of the present application, alkoxy should be taken to mean residues of the formula OR', wherein R' denotes an alkyl residue in accordance with the above-stated definition.

For the purposes of the present application, aryloxy should be taken to mean residues of the type OR", in which R" denotes an aryl residue in accordance with the above-stated definition.

For the purposes of the present application, acyl should be taken to mean an aliphatic, olefinic or aromatic carboxylic, carbonic, carbamic, sulfonic, amidosulfonic, sulfinic, phosphoric, phosphonic or phosphonous acid residue.

For the purposes of the present application, substituents which may be considered are aryl, alkyl, alkoxy, aryloxy, acyl, acyloxy, acylamino, hetaryl, alkynyl, hydroxy, cyano, carboxy, sulfo and halogen, such as preferably fluorine, chlorine or bromine.

For the purposes of the present application, an electron-attracting group is an optionally substituted carboxy, carbamoyl, acyloxy, oxycarbonyl, halogenated alkoxy, halogen-ated aryloxy, aryloxy, acyl sulfonyl, sulfinyl, sulfonyloxy, sulfonylmethyl, sulfamoyl, tetrazolyl, pyrrolyl, phosphonyl, halogenated alkyl, halogenated aryl, cyano, alkyl-sulfonylmethyl, arylsulfonylmethyl or a nitro group, as well as a halogen atom.

Seperable groups $X_{11}$ may comprise halogen, for example chlorine, N-linked, optionally substituted N-heteroaromatics, for example pyrazoles, imidazole, triazoles or non-aromatic heterocyclics, for example hydantoins, oxazolidinediones, S-linked aliphatic or aromatic mercaptans, for example mercaptopropionic acid, 2-acylamino-phenyl mercaptans, or O-linked aliphatic or aromatic hydroxy compounds, for example ethylene glycol, p-salicylic acid ethyl ester.

Preferably used compounds of the formula (I) are those of the formula (I-A)

(I-A)

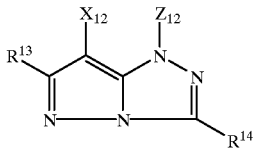

in which $R^{13}$ and $R^{14}$ mutually independently have the meaning of $R^{11}$ or $R^{12}$, $X_{12}$ has the meaning of $X_{11}$ and $Z_{12}$ denotes H or a substituent.

In the compounds of the formula (II), $R^{21}$ preferably denotes alkyl, alkoxy, alkylamino, acyl, acylamino, acyloxy, hydroxy or halogen, n and m preferably denote 0 or 1, providing that n and m are not simultaneously 1, o denotes zero, 1 or 2 and p denotes zero, 1, 2 or 3. Particularly preferred compounds of the formula (II) are those of the formula (II-A)

(II-A)

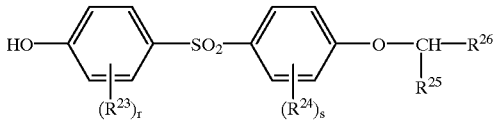

in which $R^{23}$, $R^{24}$ mutually independently denote alkyl, acyl, acylamino, alkoxy, halogen, cyano or nitro, $R^{25}$ denotes H or alkyl, $R^{26}$ denotes H, alkyl or acyl and r, s mutually independently denote 0, 1 or 2.

Table 1 below lists some particularly preferred compounds of the formula (I) or (I-A) by way of example.

| | $R^{13}$ | $R^{14}$ | $X^{12}$ | $Z^{12}$ |
|---|---|---|---|---|
| I-1 | 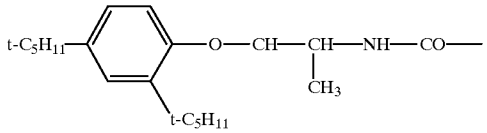 | 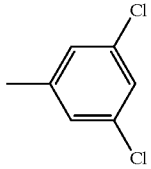 | H | H |
| I-2 | 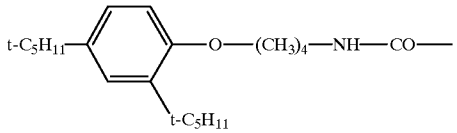 | 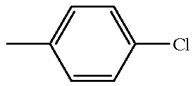 | —S—$CH_2$—$CH_2$—COOH | H |
| I-3 | 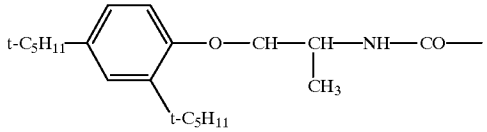 | 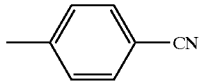 | Cl | H |
| I-4 | 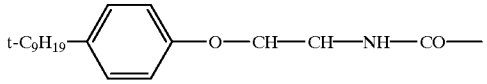 | 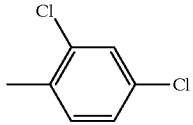 | H | H |
| I-5 | 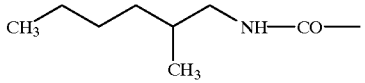 | 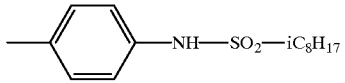 | 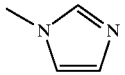 | H |
| I-6 | $C_{16}H_{33}$—O—CO—$CH_2$—$CH_2$—NH—CO— | 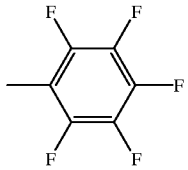 | H | H |

-continued
| | $R^{13}$ | $R^{14}$ | $X^{12}$ | $Z^{12}$ |
|---|---|---|---|---|
| I-7 | $C_{12}H_{25}$—$SO_2$—$C_3H_6$—NH—CO— | —$CF_3$ | 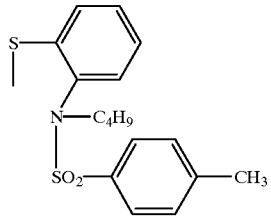 | H |
| I-8 | 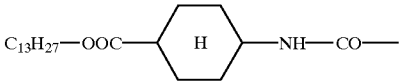 | 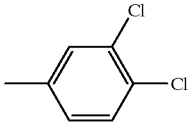 | H | H |
| I-9 | 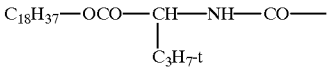 | 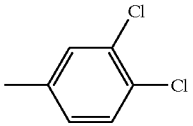 | H | H |
| I-10 | $C_{18}H_{37}$—NH—$SO_2$— | 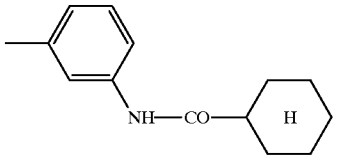 | H | H |
| I-11 | 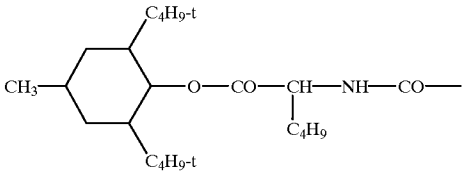 | —CN | H | H |

-continued
| | $R^{13}$ | $R^{14}$ | $X^{12}$ | $Z^{12}$ |
|---|---|---|---|---|
| I-12 | 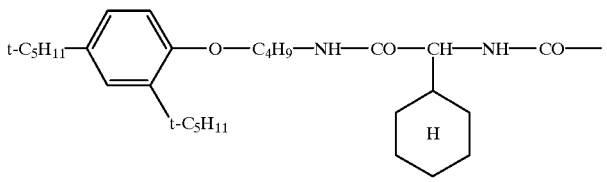 | 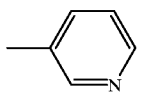 | H | H |
| I-13 | 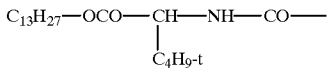 | 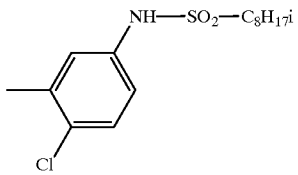 | 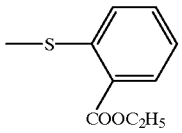 | H |
| I-14 | 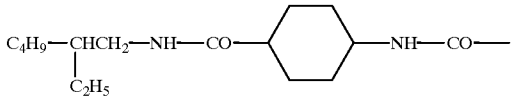 | 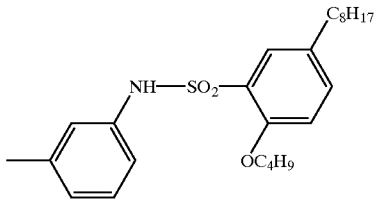 | H | H |
| I-15 | $t\text{-}C_4H_9$—NH—CO— | Copolymer from 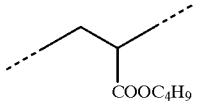 and 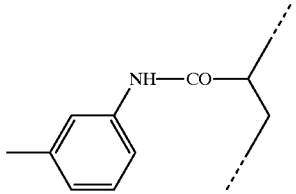 50/50 wt. % | H | H |

-continued
| | $R^{13}$ | $R^{14}$ | $X^{12}$ | $Z^{12}$ |
|---|---|---|---|---|
| I-16 | —CN | 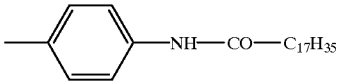 | —S—$CH_2$—$CH_2$—COOH | H |
| I-17 | 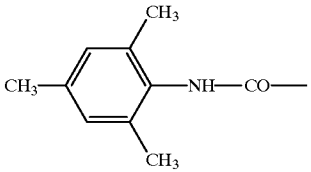 | 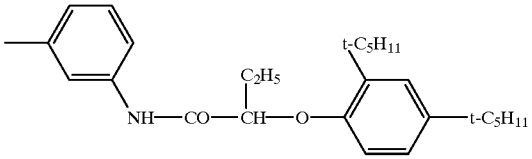 | H | H |
| I-18 | 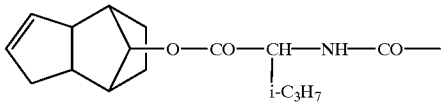 | 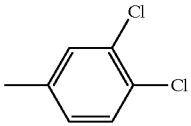 | H | H |
| I-19 | $H_{33}C_{16}$—O—CO—CH(—$C_4H_9$)—NH—CO— | 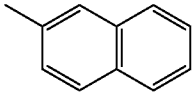 | H | H |
| I-20 | $H_{27}C_{13}$—O—CO— 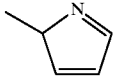 | 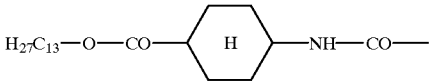 | H | H |

Some examples of the formula (II) or (II-A) which are particularly preferred according to the invention are listed below.
Examples of compounds according to the invention of the formula (II) are
II-1
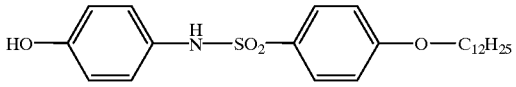
II-2
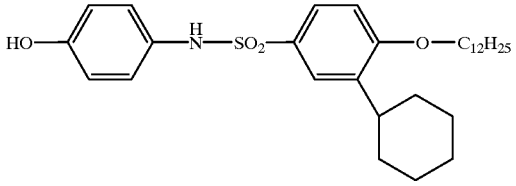
II-3
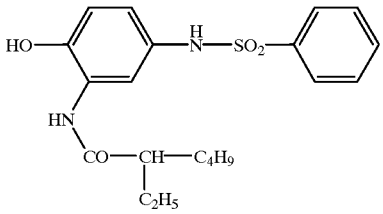
II-4
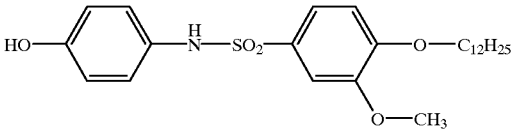
II-5
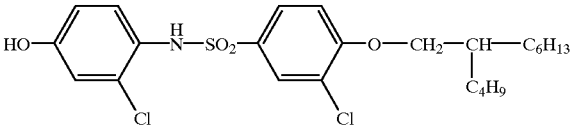
II-6
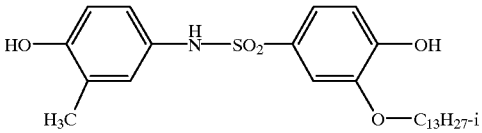
(isomer mixture)
II-7
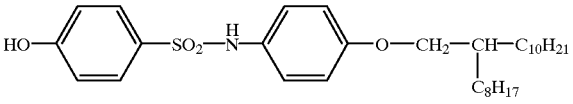
II-8
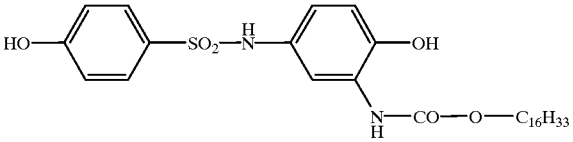
-continued
II-9
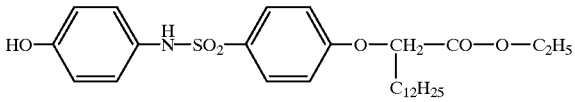
II-10
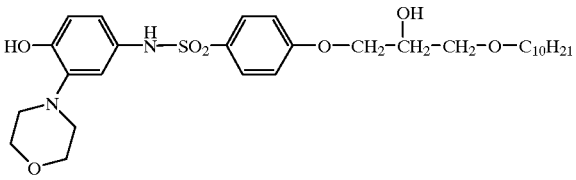
II-11
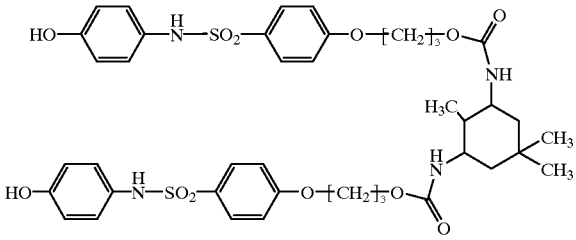
II-12
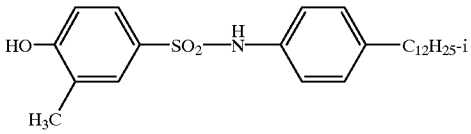
(isomer mixture)
II-13
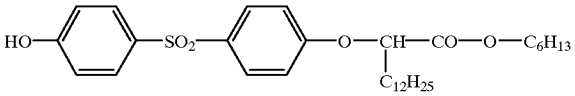
II-14
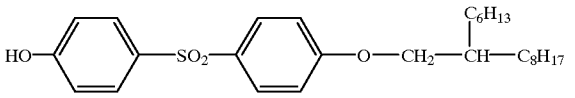
II-15
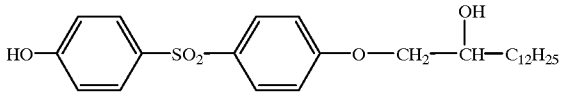
II-16
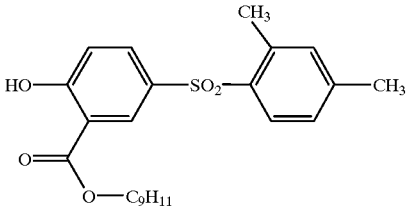

-continued

II-17

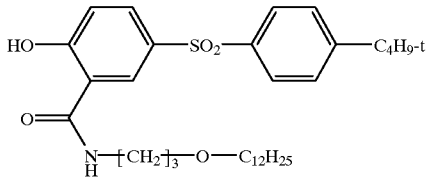

II-18

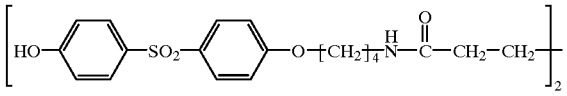

II-19

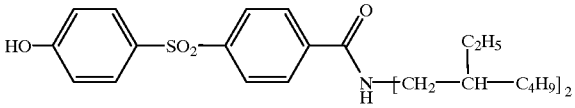

II-20

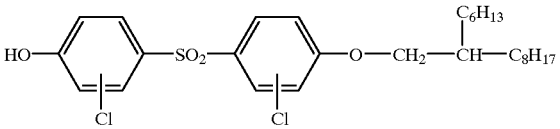

(isomer mixture)

II-21

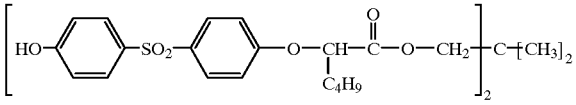

II-22

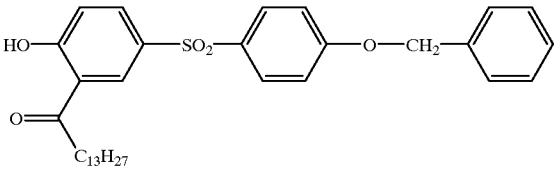

The compounds according to the invention of the formulae (I) and (II) may be used in the photographic material in conventional quantities. The compounds of the formula (I) are preferably used at a rate of 20 to 2000 mg/m$^2$ of the photographic material, in particular of 50 to 500 mg/m$^2$ of the photographic material. The compounds of the formula (II) are preferably used in a weight ratio of 20:1 to 1:10 relative to the compounds of the formula (I), in particular in a weight ratio of 10:1 to 1:5 and particularly preferably in a weight ratio of 5:1 to 1:2.

The compounds according to the invention of the formulae (I) and (II) are preferably used in a red-sensitised silver halide emulsion layer or directly adjacent to a red-sensitised silver halide emulsion layer. The compounds of the formulae (I) and (II) are in particular used in the same layer.

Examples of colour photographic materials are colour negative films, colour reversal films, colour positive films, colour photographic paper, colour reversal photographic paper, colour-sensitive materials for the dye diffusion transfer process or the silver dye bleaching process. A review is given in *Research Disclosure* 37038 (1995) and *Research Disclosure* 38957 (1996).

The photographic materials consist of a support onto which at least one photosensitive silver halide emulsion layer is applied. Thin films and sheets are in particular suitable as supports. A review of support materials and the auxiliary layers applied to the front and reverse sides of which is given in *Research Disclosure* 37254, part 1 (1995), page 285 and in *Research Disclosure* 38957, part XV (1996), page 627.

The colour photographic materials conventionally contain at least one red-sensitive, one green-sensitive and one blue-sensitive silver halide emulsion layer, optionally together with interlayers and protective layers.

Depending upon the type of the photographic material, these layers may be differently arranged. This is demonstrated for the most important products:

Colour photographic films such as colour negative films and colour reversal films have on the support, in the stated sequence, 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers. The layers of identical spectral sensitivity differ with regard to their photographic sensitivity, wherein the less sensitive sub-layers are generally arranged closer to the support than the more highly sensitive sub-layers.

A yellow filter layer, which prevents blue light from reaching the underlying layers, is conventionally located between the green-sensitive and blue-sensitive layers.

Possible options for different layer arrangements and the effects thereof on photographic properties are described in *J. Inf. Rec. Mats.*, 1994, volume 22, pages 183–193 and in *Research Disclosure* 38957, part XI (1996), page 624.

Colour photographic paper, which is usually substantially less photosensitive than a colour photographic film, conventionally has on the support, in the stated sequence, one blue-sensitive, yellow-coupling silver halide emulsion layer, one green-sensitive, magenta-coupling silver halide emulsion layer and one red-sensitive, cyan-coupling silver halide emulsion layer; the yellow filter layer may be omitted.

The number and arrangement of the photosensitive layers may be varied in order to achieve specific results. For example, all high sensitivity layers may be grouped together in one package of layers and all low sensitivity layers may be grouped together in another package of layers in order to increase sensitivity (DE-25 30 645).

The substantial constituents of the photographic emulsion layers are binder, silver halide grains and colour couplers.

Details of suitable binders may be found in *Research Disclosure* 37254, part 2 (1995), page 286 and in *Research Disclosure* 38957, part II.A (1996), page 598.

Details of suitable silver halide emulsions, the production, ripening, stabilisation and spectral sensitisation thereof, including suitable spectral sensitisers, may be found in *Research Disclosure* 37254, part 3 (1995), page 286, in *Research Disclosure* 37038, part XV (1995), page 89 and in *Research Disclosure* 38957, part V.A (1996), page 603.

Photographic materials with camera sensitivity conventionally contain silver bromideiodide emulsions, which may optionally also contain small proportions of silver chloride. Photographic print materials contain either silver chloride-bromide emulsions with up to 80 wt. % of AgBr or silver chloride-bromide emulsions with above 95 mol. % of AgCl.

Details relating to colour couplers may be found in *Research Disclosure* 37254, part 4 (1995), page 288, in *Research Disclosure* 37038, part II (1995), page 80 and in

*Research Disclosure* 38957, part X.B (1996), page 616. The maximum absorption of the dyes formed from the couplers and the developer oxidation product is preferably within the following ranges: yellow coupler 430 to 460 nm, magenta coupler 540 to 560 nm, cyan coupler 630 to 700 nm.

In order to improve sensitivity, grain, sharpness and colour separation in colour photographic films, compounds are frequently used which, on reaction with the developer oxidation product, release photographically active compounds, for example DIR couplers which eliminate a development inhibitor.

Details relating to such compounds, in particular couplers, may be found in *Research Disclosure* 37254, part 5 (1995), page 290, in *Research Disclosure* 37038, part XIV (1995), page 86 and in *Research Disclosure* 38957, part X.C (1996), page 618.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present in the layers as fine droplets (0.05 to 0.8 $\mu$m in diameter).

Suitable high-boiling organic solvents, methods for the introduction thereof into the layers of a photographic material and further methods for introducing chemical compounds into photographic layers may be found in *Research Disclosure* 37254, part 6 (1995), page 292.

The non-photosensitive interlayers generally located between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in *Research Disclosure* 37254, part 7 (1995), page 292, in *Research Disclosure* 37038, part III (1995), page 84 and in *Research Disclosure* 38957, part X.D (1996), pages 621 et seq.

The photographic material may also contain UV light absorbing compounds, optical brighteners, spacers, filter dyes, formalin scavengers, light stabilisers, anti-oxidants, $D_{min}$ dyes, plasticisers (latices), biocides and additives to improve the stability of dyes and couplers, to reduce colour fogging and to reduce yellowing and others. Suitable compounds may be found in *Research Disclosure* 37254, part 8 (1995), page 292, in *Research Disclosure* 37038, parts IV, V, VI, VII, X, XI and XIII (1995), pages 84 et seq. and in *Research Disclosure* 38957, parts VI, VIII, IX and X (1996), pages 607 and 610 et seq.

The layers of colour photographic materials are conventionally hardened, i.e. the binder used, preferably gelatine, is crosslinked by appropriate chemical methods.

Suitable hardener substances may be found in *Research Disclosure* 37254, part 9 (1995), page 294, in *Research Disclosure* 37038, part XII (1995), page 86 and in *Research Disclosure* 38957, part II.B (1996), page 599.

Once exposed with an image, colour photographic materials are processed using different processes depending upon their nature. Details relating to processing methods and the necessary chemicals are disclosed in *Research Disclosure* 37254, part 10 (1995), page 294, in *Research Disclosure* 37038, parts XVI to XXIII (1995), pages 95 et seq. and in *Research Disclosure* 38957, parts XVIII, XIX and XX (1996), pages 630 et seq. together with example materials.

Compounds of the formula (III) are preferably used as dye stabilisers (III)

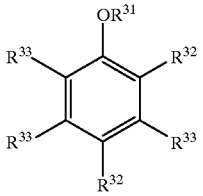

in which $R^{31}$ denotes H, alkyl, alkenyl, aryl or acyl, $R^{32}$ denotes H, alkyl, alkoxy, aryloxy, acylamino, alkylamino, arylamino, hydroxy or hetaryl and $R^{33}$ denotes H, alkyl, alkenyl, aryl, acyl or chlorine, wherein two or more residues $R^{32}$ and $R^{33}$ may be identical or different.

Typical examples of compounds of the formula (III) are

III-1

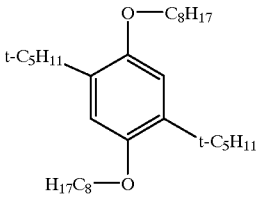

III-2

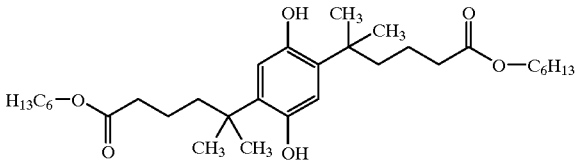

III-3

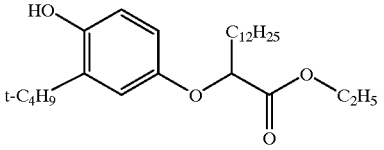

III-4

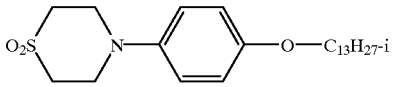

(isomer mixture)

-continued
III-5
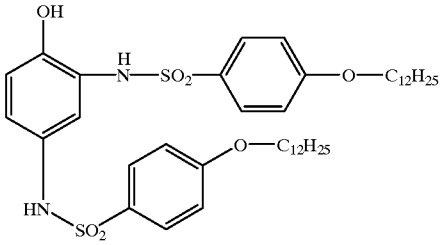
III-6
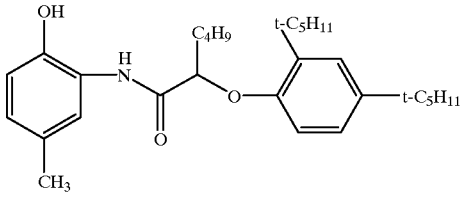
III-7
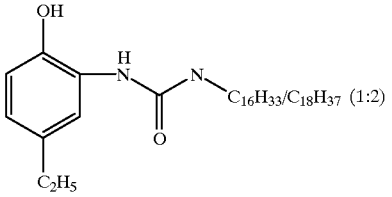
III-8
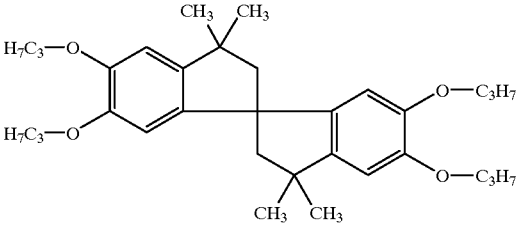
III-9
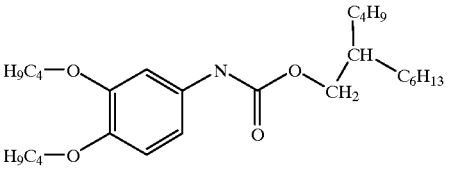
III-10
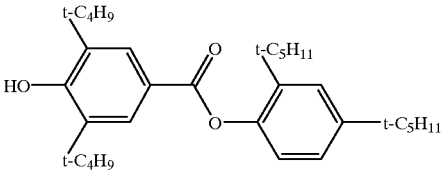
III-11
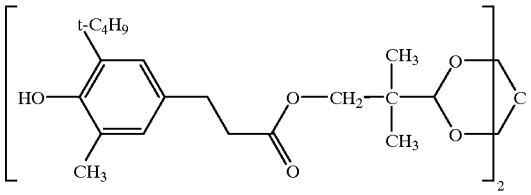
III-12
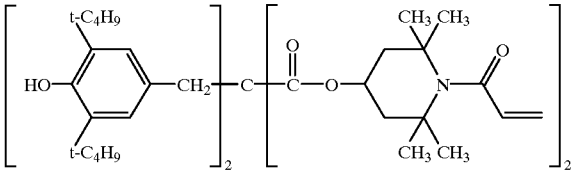
III-13
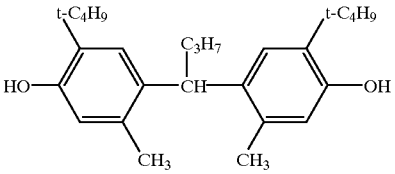
III-14
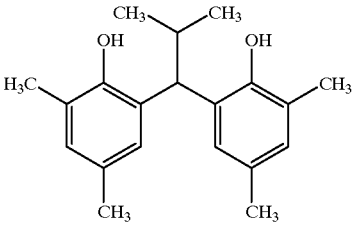
III-15
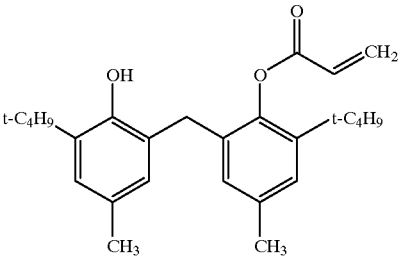
III-16
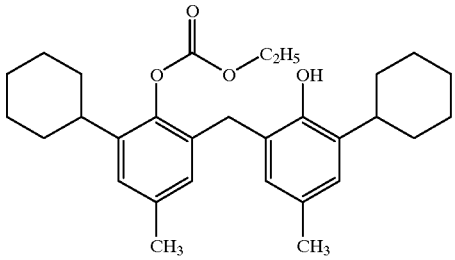

-continued

III-17

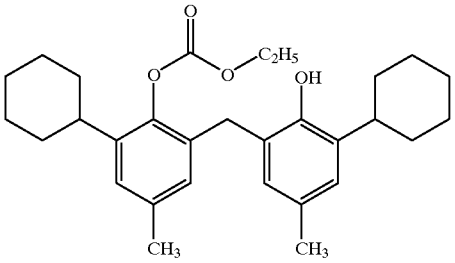

III-18

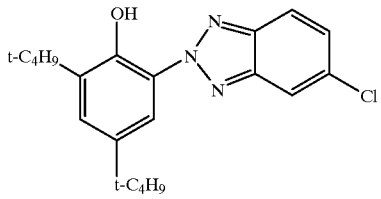

III-19

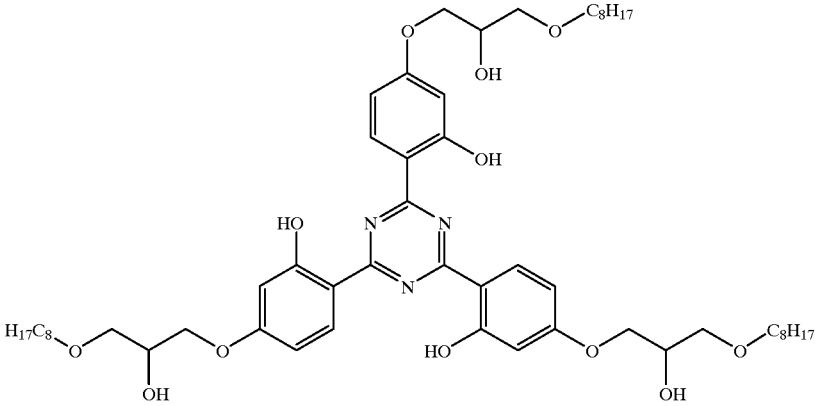

III-20

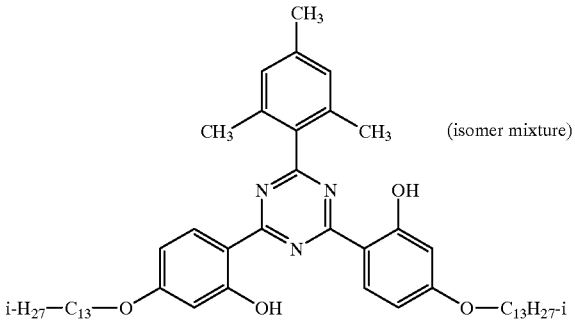

(isomer mixture)

The compounds of the formula (III) are preferably used together with the compounds of the formulae (I) and (II) in the same layer.

EXAMPLE

Layer Structure 1

A colour photographic recording material was produced by applying the following layers in the stated sequence onto a layer support made from paper coated on both sides with polyethylene. Quantities are all stated per 1 $m^2$. The silver halide application rate is stated as the corresponding quantities of $AgNO_3$.

Layer 1: (Substrate layer)

0.10 g of gelatine

Layer 2: (Blue-sensitive layer)

Blue-sensitive silver halide emulsion (99.5 mol. % chloride, 0.5 mol. % bromide, average grain diameter 0.9 $\mu$m) prepared from 0.46 g of $AgNO_3$ with
0.70 mg of blue sensitiser BS-1
0.30 mg of stabiliser ST-1
1.25 g of gelatine
0.48 g of yellow coupler Y-1
0.20 g of image stabiliser BST-1
0.50 g of oil former OF-1

Layer 3: (Interlayer)

1.10 g of gelatine
0.06 g of DOP scavenger EF-1
0.06 g of DOP scavenger EF-2
0.12 g of tricresyl phosphate (TCP)

Layer 4: (Green-sensitive layer)

Green-sensitised silver halide emulsion (99.5 mol. % chloride, 0.5 mol. % bromide, average grain diameter 0.47 $\mu$m) prepared from 0.26 g of $AgNO_3$ with
0.70 mg of green stabiliser GS-1
0.50 mg of stabiliser ST-2
0.77 g of gelatine
0.24 g of magenta coupler M-1
0.20 g of image stabiliser BST-2
0.09 g of image stabiliser BST-3

-continued

| | | |
|---|---|---|
| | 0.24 g | of dibutyl phthalate DBP) |
| | 0.24 g | of isotetradecanol |
| Layer 5: (UV protective layer) | | |
| | 0.95 g | of gelatine |
| | 0.50 g | of UV absorber UV-1 |
| | 0.03 g | of DOP scavenger EF-1 |
| | 0.03 g | of DOP scavenger EF-2 |
| | 0.15 g | of oil former OF-2 |
| | 0.15 g | of TCP |
| Layer 6: (Red-sensitive layer) | | |
| | Red-sensitised silver halide emulsion (99.5 mol. % chloride, 0.5 mol. % bromide, average grain diameter 0.5 μm) prepared from 0.30 g of $AgNO_3$ with | |
| | 0.03 mg | of red sensitiser RS-1 |
| | 0.60 mg | of stabiliser ST-3 |
| | 1.00 g | of gelatine |
| | 0.35 g | of cyan coupler C-1 |
| | 0.70 g | of dibutyl adipate |
| Layer 7: (UV protective layer) | | |
| | 0.30 g | of gelatine |
| | 0.20 g | of UV absorber UV-2 |
| | 0.10 g | of oil former OF-3 |
| Layer 8: (Protective layer) | | |
| | 0.90 g | of gelatine |
| | 0.05 g | of optical brightener WT-1 |
| | 0.07 g | of mordant (polyvinylpyrrolidone) |
| | 1.20 mg | of silicone oil |
| | 2.50 mg | of spacers (polymethyl methacrylate, average particle size 0.8 μm) |
| | 0.30 g | of hardener H-1 |

Compounds used in layer structure 1:

BS-1

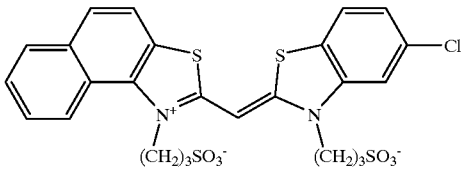

$(C_2H_5)_3N^+H$

GS-1

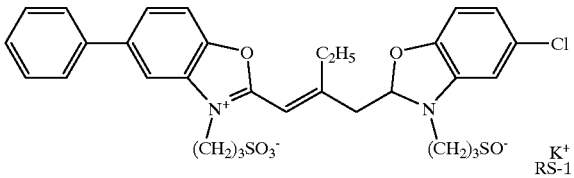

$K^+$

RS-1

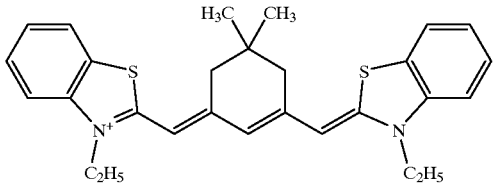

$I^-$

-continued

ST-1

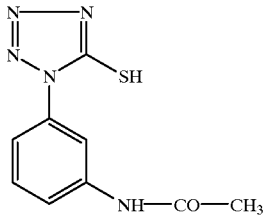

ST-2

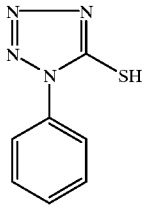

ST-3

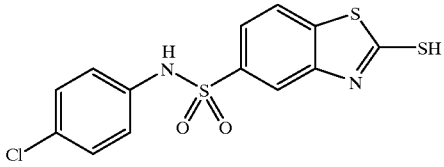

Y-1

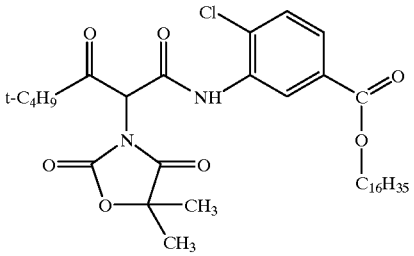

M-1

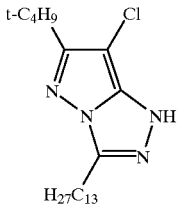

C-1

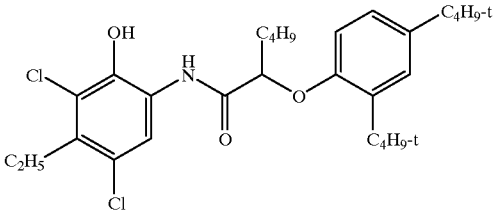

-continued
BST-1
1:1 mixture of
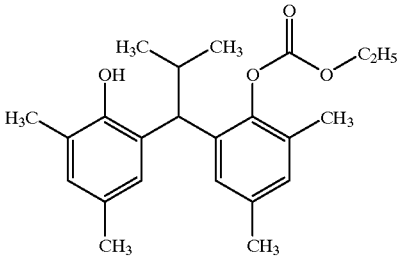
and
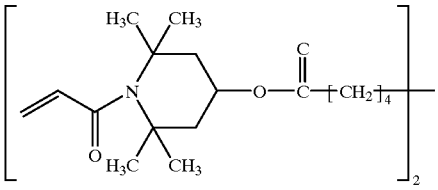
BST-2
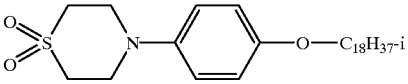
(isomer mixture)
BST-3
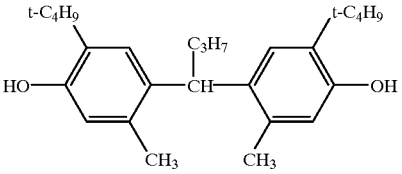
-continued
EF-1
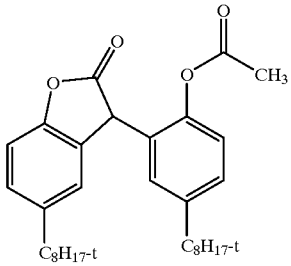
EF-2
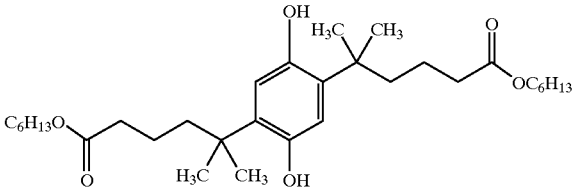
OF-1
Polyester prepared from HOOC—$(CH_2)_4$—COOH, η (20° C.): 4000–5000 mPa.s HO—$CH_2$—$C(CH_3)_2$—$CH_2$—OH and $C_{10}H_{21}$—i $n_D$ (20° C.): 1.464–1.467
OF-2
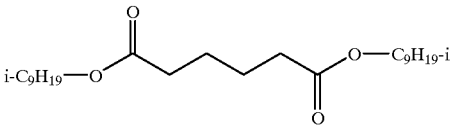
OF-3
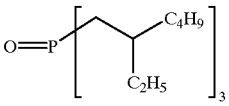
UV-1
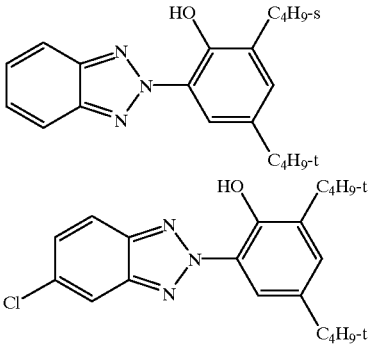
in a 9:1 weight ratio
UV-2
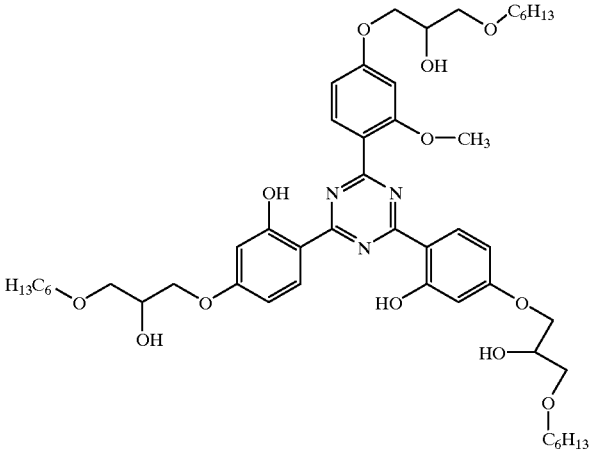
and -continued

WT-1

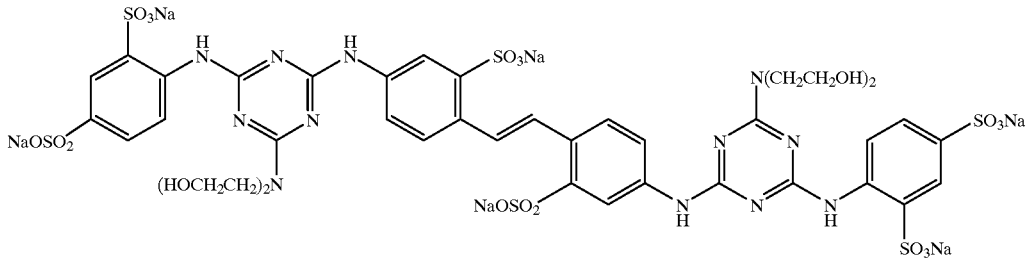

H-1

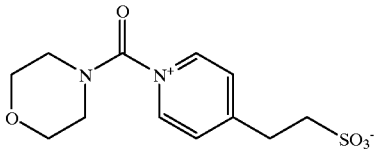

Layer Structures 2 to 10

Layer structures 2 to 10 correspond to layer structure 1 with regard to layer structure and composition and differ only in that the cyan coupler C-1 and TCP in layer 6 were replaced with the substances stated in Table 1. In samples 4, 9 and 10, the silver application rate was additionally reduced to 0.30 g/m$^2$.

The samples were exposed through a step wedge, wherein colour filters were placed in the beam path in such a manner that only the red-sensitive layer was exposed. Processing was then performed as follows:

| | | |
|---|---|---|
| a) | Colour developer - 45 s - 35° C. | |
| | Tetraethylene glycol | 20.0 g |
| | N,N-diethylhydroxylamine | 2.0 g |
| | N,N-bis-(2-sulfoethyl)hydroxylamine, disodium salt | 2.0 g |
| | N-ethyl-N-(2-methanesulfonamidoethyl)-4-amino-3-methyl-benzene sulfate | 5.0 g |
| | Potassium sulfite | 0.2 g |
| | Potassium carbonate | 30.0 g |
| | Hydroxyethanediphosphonic acid | 0.2 g |
| | Polymaleic anhydride | 2.5 g |
| | Optical brightener (4,4'-diaminostilbenesulfonic acid derivative) | 2.0 g |
| | Potassium bromide | 0.02 g |
| | make up to 1000 ml with water; adjust pH to 10.2 with KOH or $H_2SO_4$ | |
| b) | Bleach/fixing bath - 45 s 35° C. | |
| | Ammonium thiosulfate | 75.0 g |
| | Sodium hydrogen sulfite | 13.5 g |
| | Ethylenediaminetetraacetic acid (iron/ammonium salt) | 45.0 g |
| | make up to 1000 ml with water; adjust pH to 6.0 with ammonia (25 wt. %) or acetic acid. | |
| c) | Rinsing - 90 s - 33° C. | |
| d) | Drying | |

Maximum density ($D_{max}$) and gradation ($\gamma$) were then measured (Table 2). The percentage magenta density ($Nd_{magenta}$) at $D_{cyan}$=1.0 and the absorption maximum ($\lambda_{max}$) were also determined (Table 2).

The samples were furthermore exposed to $10 \cdot 10^6$ lux.h of light from a daylight-standardised xenon lamp. The percentage decrease in density at an initial density $D_{cyan}$ of 1.0 was determined ($\Delta D_{1.0}$, Table 2).

The samples were moreover stored in the dark for 42 days at 85° C. and 60% relative humidity and the percentage decrease in maximum density ($D_{max}$) determined (Table 2).

TABLE 1

(C = comparison; I = according to the invention)

| | Coupler | | Oil former | |
|---|---|---|---|---|
| Layer structure | Compound | mg/m$^2$ | | mg/m$^2$ |
| 1 (C) | C-1 | 350 | TCP | 700 |
| 2 (C) | I-8 | 300 | TCP | 600 |
| 3 (C) | I-8 | 300 | V-1/TCP | 400/200 |
| 4 (C) | I-3 | 300 | V-2 | 600 |
| 5 (I) | I-8 | 300 | II-1/TCP | 400/200 |
| 6 (I) | I-8 | 300 | II-7 | 600 |
| 7 (I) | I-8 | 300 | II-13 | 600 |
| 8 (I) | I-8 | 300 | II-14 | 600 |
| 9 (I) | I-3 | 300 | II-13 | 600 |
| 10 (I) | I-3 | 300 | II-19/TCP | 400/200 |

TABLE 2

(C = comparison; I = according to the invention)

| Layer structure no. | Sensitometry $D_{max}$ | $\gamma$ | Colour reproduction $\lambda_{max}$ [nm] | $Nd_{magenta}$ [%] | Light stability $\Delta D_{1.0}$ [%] | Dark storage stability $\Delta D_{max}$ [%] |
|---|---|---|---|---|---|---|
| 1 (C) | 2.50 | 3.71 | 660 | 26.5 | −16 | −46 |
| 2 (C) | 2.55 | 3.47 | 650 | 31.7 | −34 | −42 |
| 3 (C) | 2.58 | 3.66 | 654 | 27.2 | −26 | −35 |
| 4 (C) | 2.61 | 3.64 | 652 | 30.0 | −31 | −39 |
| 5 (I) | 2.55 | 3.70 | 659 | 23.4 | −20 | −31 |
| 6 (I) | 2.58 | 3.68 | 658 | 24.2 | −21 | −29 |
| 7 (I) | 2.65 | 3.75 | 659 | 23.3 | −17 | −30 |
| 8 (I) | 2.59 | 3.72 | 660 | 22.8 | −19 | −32 |
| 9 (I) | 2.68 | 3.88 | 661 | 21.9 | −17 | −28 |
| 10 (I) | 2.60 | 3.69 | 659 | 23.9 | −20 | −30 |

The following were used as comparison compounds

V-1

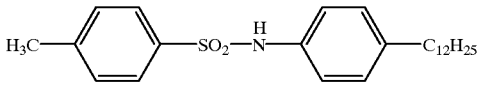

-continued

V-2

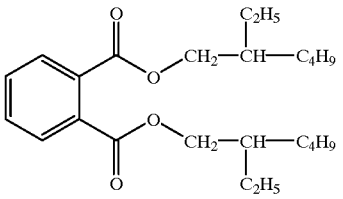

As Table 2 shows, using the coupler according to the invention (I) gives rise to a cyan image having improved dark storage stability relative to C-1.

However, colour reproduction and light stability are then unsatisfactory. Only when compounds according to the invention of the formula (II) are simultaneously used is satisfactory light stability achieved together with colour reproduction which is even distinctly improved relative to C-1.

What is claimed is:

1. A color photographic material which comprises at least one silver halide emulsion layer sensitized for the red range of the spectrum, which layer contains associated therewith at least one compound of the formula (I)

(I)

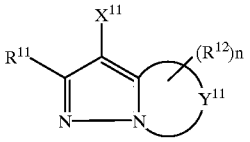

in which $R^{11}$ and $R_{12}$ mutually and independently denote an electron-attracfing group, $X^{11}$ denotes H or a group separable on reaction with the developer oxidation product, $y^{11}$ denotes a group to complete a nitrogenous heterocycle, providing that a group represented by $R^{12}$ is attached to a carbon atom of the heterocycle, n denotes 1 or 2, and at least one pound of the formula (II-A)

(II-A)

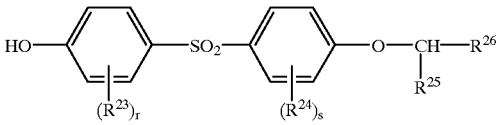

in which $R^{23}$ and $R^{24}$ mutually and independently denote alkyl, acyl, acylamino, alkoxy, halogen, cyano or nitro, $R^{25}$ denotes H or alkyl, $R^{26}$ denotes H, alkyl or acyl and r and s mutually and independently denote 0, 1 or 2 providing that the compound contains a total of at least 16 C atoms.

2. The color photographic material according to claim 1, wherein the compounds of the formula (I) comprise the compound of the formula (I-A);

(I-A)

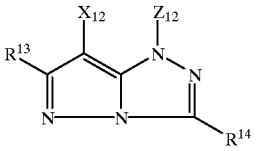

in which $R^{13}$ and $R^{14}$ mutually and independently have the meaning of $R^{11}$ or $R^{12}$, $X_{12}$ has the meaning of $X^{11}$ and $Z_{12}$ denotes H or a substituent.

3. The color photographic material according to claim 1, wherein the compound of the formula (I) Ls in a quantity of 50 to 500 mg/m$^2$ of the photographic recording material.

4. The color photographic material according to claim 1, wherein it contains the compounds of the formula (II-A) are present in a weight ratio of 20:1 to 1:10 relative to the compound of the formula (I).

5. The color photographic material according to claim 1, which further comprises compounds of the formula (III)

(III)

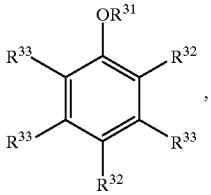

in which $R^{31}$ denotes H, alkyl, alkenyl, aryl or acyl, $R^{32}$ denotes H, alkyl, alkoxy, aryloxy, acylamino, alkylamino, arylamino, hydroxy or hetaryl and $R_{33}$ denotes H, alkyl, alkenyl, aryl, acyl or chlorine, wherein two or more residues $R^{32}$ and $R_{33}$ may be identical or different.

6. The color photographic material according to claim 1, wherein the compounds of the formulae (I) and (II-A) are present in a red-sensitized silver halide emulsion layer or directly adjacent to a red-sensitised silver halide emulsion layer.

7. The color photographic material according to claim 1, wherein the compounds of the formulae (I) and (II-A) are used in the same layer.

8. The color photographic material according to claim 6, wherein the compounds of the formulae (I), (II-A) and (III) are present in the same layer.

9. The color photographic material, as claimed in claim 1, wherein $R_{11}$ and $R^{12}$ mutually and independently denote an optionally substituted carboxy, carbamoyl, acyloxy, oxycarbonyl, halogenated alkoxy, halogenated aryloxy, aryloxy, acyl sulfonyl, sulfinyl, sulfonyloxy, sulfonylmethyl, sulfamoyl, tetrazolyl, pyrrolyl, phosphonyl, halogenated alkyl, halogenated aryl, cyano, alkylsulfonylmethyl, arylsulfonylmethyl, a nitro group, a halogen atom and $X^{11}$ is halogen, N-linked, optionally substituted N-heteroaromatics, non-aromatic heterocyclics, S-linked aliphatic or aromatic mercaptans or O-linked aliphatic or aromatic hydroxy compounds.

10. The color photographic material according to claim 9, wherein $X^{11}$ is chlorine, pyrazole, imidazole, triazole, hydantoin, oxazolidinedione, mercaptopropionic acid, 2-acylaminophenyl mercaptan, ethylene glycol or p-salicyclic acid ethyl ester.

11. The color photographic recording material according to claim 1, wherein the compound of the formula I is in a quantity of 20 to 2,000 mg/m$^2$ of the photographic recording material.

12. The color photographic recording material according to claim 4, wherein the compounds of the formula (II-A) are present in a weight ratio of 10:1 to 1:5 relative to the compounds of formula I.

13. The color photographic recording material according to claim 4, wherein the compounds of the formula (II-A) are present in a weight ratio of 5:1 to 1:2 relative to the compounds of formula.

* * * * *

UNITED STATES PATENT AND TRADEMARK OFFICE

CERTIFICATE OF CORRECTION

PATENT NO. : 6,242,169 B1
DATED : June 5, 2001
INVENTOR(S) : Jörg Hagemann et al.

It is certified that error appears in the above-identified patent and that said Letters Patent is hereby corrected as shown below:

Column 29,
Line 37, "$R^{11}$ and $R_{12}$" should read -- $R^{11}$ and $R^{12}$ --.
Line 42, "$y^{11}$" should read -- $Y^{11}$ --.

Column 30,
Line 17, "Ls" should read -- is --.
Line 55, "$R_{11}$ and $R^{12}$ should read -- $R^{11}$ and $R^{12}$ --.

Signed and Sealed this

Fifteenth Day of January, 2002

*Attest:*

*Attesting Officer*

JAMES E. ROGAN
*Director of the United States Patent and Trademark Office*